US005941304A

United States Patent [19]

Inaba et al.

[11] Patent Number: 5,941,304

[45] Date of Patent: Aug. 24, 1999

[54] CONNECTOR FOR HEAT EXCHANGER

[75] Inventors: Hiroyuki Inaba, Saitama; Kazunobu Igai, Gunma; Etsuko Yamazaki, Tochigi, all of Japan

[73] Assignee: Calsonic Corporation, Tokyo, Japan

[21] Appl. No.: 08/901,673

[22] Filed: Jul. 28, 1997

[30] Foreign Application Priority Data

Jul. 26, 1996 [JP] Japan ..... 8-197724

[51] Int. Cl.[6] ..... F28F 9/04

[52] U.S. Cl. ..... 165/178; 285/197

[58] Field of Search ..... 165/178, 67; 285/197, 285/198, 199

[56] References Cited

U.S. PATENT DOCUMENTS

| | | | |
|---|---|---|---|
| 5,271,460 | 12/1993 | O'Brien | 165/178 |
| 5,289,870 | 3/1994 | Dierbeck | 165/178 X |
| 5,363,910 | 11/1994 | Baba et al. . | |
| 5,379,834 | 1/1995 | Tokutake | 165/178 |
| 5,456,089 | 10/1995 | O'Brien | 165/149 X |
| 5,477,919 | 12/1995 | Karube . | |

FOREIGN PATENT DOCUMENTS

| | | | |
|---|---|---|---|
| 55-45572 | 3/1980 | Japan . | |
| 5-322476 | 12/1993 | Japan . | |
| 229696 | 8/1994 | Japan | 165/178 |

*Primary Examiner*—Leonard Leo
*Attorney, Agent, or Firm*—Foley & Lardner

[57] ABSTRACT

A heat exchanger includes at least one elongate header of metal, a plurality of refrigerant flow tubes each having one open end exposed to the interior of the header and a plurality of heat radiation fins extending along the tubes. A connector of metal is brazed to the header to provide a fluid communication between the interior of the header and an external pipe member through an opening formed in a wall of the header. The connector comprises a mating surface which mates the wall of the header; a connecting surface positioned at an opposite side of the mating surface; a pair of side surfaces each being positioned between the mating and connecting surfaces; a through bore which extends between the mating and connecting surfaces; and a groove formed in each of the side surfaces along an axis of the elongate header. The groove is positioned close to the mating surface to leave or define therebetween a thin mounting portion of the connector. The thin mounting portion is so sized as to achieve a desired argon arc spot welding between the connector and the wall of the header.

12 Claims, 3 Drawing Sheets

CONNECTOR FOR HEAT EXCHANGER

BACKGROUND OF THE INVENTION

1. Field of the Invention

The present invention relates in general to connectors used in a fluid circuit for an automotive air cooling system, and more particularly to connectors of a type which is mounted to a header (viz., refrigerant collection tank) of a heat exchanger to provide a fluid communication between the header and a fluid pipe connected to the connector.

2. Description of the Prior Art

In order to clarify the task of the present invention, one conventional connector of the above-mentioned type will be described with respect to FIGS. 5 and 6 of the accompanying drawings.

In FIG. 5, there is shown a heat exchanger 1 to which two conventional connectors 7 and 8 are practically applied.

The heat exchanger 1 shown is a condenser installed in a fluid circuit of an automotive air cooling system. That is, the condenser is a device for changing high pressure refrigerant gas to a liquid by emitting heat from the hot refrigerant to the cooler atmosphere.

As shown in FIG. 5, the heat exchanger 1 comprises generally inlet and outlet headers (or refrigerant collection tanks) 2 and 3 which are laterally spaced. These headers 2 and 3 are each constructed of an aluminum alloy or the like. Between these headers 2 and 3, there extend a plurality of rectangular-section refrigerant flow tubes 4 and a plurality of corrugated heat radiation fins 5 which are alternatively arranged. The tubes 4 and fins 5 are each constructed of an aluminum alloy or the like. The tubes 4 and fins 5 thus constitute a core portion 6 of the heat exchanger 1. Each header 2 or 3 is a cylindrical hollow member having upper and lower ends hermetically closed. Each tube 4 has both open ends exposed to the interior of the headers 2 and 3. For this exposure, each header 2 or 3 has at an inner side thereof a plurality of rectangular openings into which the open ends of the tubes 4 are received. Brazing is used for hermetically and securely connecting the parts of the heat exchanger 1. A bracket 9 is fixed to an upper portion of the outlet header 3, which is used for mounting the heat exchanger 1 to a vehicle body. When needed, a similar bracket is fixed to the inlet header 2 for the same purpose.

An inlet connector 7 is mounted to an upper portion of the inlet header 2 and an outlet connector 8 is mounted to a lower portion of the outlet header 3. To the inlet connector 7, there is connected a pipe 13*a* which extends from a compressor (not shown) of the fluid circuit of the air cooling system, and to the outlet connector 8, there is connected a pipe 13*b* which extends to an expansion valve (not shown) of the fluid circuit. Accordingly, under operation of the air cooling system, high pressure high temperature refrigerant gas from the compressor is led into the heat exchanger 1 through the inlet connector 7, and condensed liquid refrigerant thus collected in a lower portion of the outlet header 3 is led to the expansion valve through though the outlet connector 8.

FIG. 6 shows in detail a manner in which the outlet connector 8 is mounted to the outlet header 3. It is to be noted that the inlet connector 7 is mounted to the inlet header 2 in substantially the same manner as in the outlet connector 8.

As is seen from FIG. 6, the outlet connector 8, which is constructed of an aluminum alloy, is of a generally rectangular-parallelepiped block including six surfaces, which are a header mating surface 10, a pipe connecting surface 11, a pair of side surfaces 12*a* and 12*b*, an upper surface 12*c* and a lower surface 12*d*. The mating surface 10 is concave to intimately mate with a cylindrical outer surface of the outlet header 3. The outlet connector 8 is secured to the lower portion of the outlet header 3 through a brazing "C" applied entirely to the mating portions of the connector 8 and the header 3. The outlet connector 8 is formed with both a through bore 14 which extends between the mating and connecting surfaces 10 and 11, and a threaded bore 15 which is exposed to the connecting surface 11. Although not shown in the drawing, the through bore 14 is exposed to the interior of the outlet header 3 through an opening formed in the cylindrical wall of the outlet header 3. When the heat exchanger 1 is installed in the fluid circuit of the air cooling system, a leading end of the pipe 13*b* is intimately and hermetically thrust into the through bore 14 through a seal member (not shown). For tight connection between the pipe 13*b* and the outlet connector 8, a bolt 50 held by a flange 52 of the pipe 18*b* is engaged with the threaded bore 15.

As has been mentioned hereinabove, brazing is employed for assembling the heat exchanger 1. More specifically, before carrying out the brazing, the parts of the heat exchanger 1 are provisionally assembled with usage of suitable tools in such a manner that neighboring parts contact at their mating portions. One of the mating portions has a brazing sheet (clad) previously applied thereto. The brazing sheet is made of an aluminum alloy including a larger amount of silicon. Furthermore, before the brazing, the inlet and outlet connectors 7 and 8 are provisionally or incompletely fixed to the respective headers 2 and 3 through argon arc spot welding. The parts thus provisionally assembled are then put into a furnace of a certain atmosphere for a given time to achieve brazing. With this, the heat exchanger 1 is tightly assembled.

However, hitherto, it is very difficult to produce or assemble a heat exchanger 1 which is free of ill-brazing. In fact, if such ill-brazing occurs, the heat exchanger 1 produced tends to suffer from undesired leakage of refrigerant from the ill-brazed portion when practically operated in the fluid circuit of the air cooling system. Accordingly, in these days, when produced, all of the heat exchangers 1 are subjected to a leakage test using a compressed air.

In the leakage test, one of the through ports 14 of the inlet and outlet connectors 7 and 8 is closed by a plug, and a compressed air is led into the heat exchanger 1 through the other through port 14, and the pressure in the heat exchanger 1 is monitored for a given time. If a certain reduction of the pressure is found, it is judged that the heat exchanger 1 has at least one ill-brazed portion to cause such air leakage.

However, due to inherent construction of the inlet and outlet connectors 7 and 8, the heat exchanger 1 has the following drawbacks.

First, it is difficult to effectively use the argon arc spot welding for provisionally fixing the inlet and outlet connectors 7 and 8 to the respective headers 2 and 3. In fact, the work for arc-welding the connectors 7 and 8 to the headers 2 and 3 needs a lot of time for its difficulty. This is because of a marked difference in thermal capacity between the connector 7 or 8 and the header 2 or 3. As is easily understood from FIG. 6, due to the solid and bulky structure, each connector 8 or 7 has a great thermal capacity as compared with a portion of the header 3 or 2 to which the connector 8 or 7 is welded. Considering that a desired argon arc spot welding is obtained only when the welding is applied to parts which have been heated up to the same level, such great difference in thermal capacity makes the argon arc spot welding to such parts 8 and 3 (or 7 and 2) very difficult.

Second, the leakage test is troublesome and time consuming. In fact, before feeding a compressed air into the heat exchanger 1 for the test, the following steps are needed. First, a plug is fitted to one through bore 14 of the connector 7 or 8 and a bolt held by the plug is engaged with the threaded bore 15 of the connector 7 or 8. Then, an air feeding tube extending from an air compressor is fitted to the other through bore 14 of the other connector 8 or 7 and a bolt held by the tube is engaged with the threaded bore 15 of the other connector 8 or 7. Once the leakage test is finished, the plug and the air feeding tube are removed from the respective connectors 7 and 8 by carrying out a reversed manual work. These steps are troublesome and time consuming.

SUMMARY OF THE INVENTION

It is therefore an object of the present invention to provide a connector of heat exchanger, which can solve the above-mentioned drawbacks.

According to a first aspect of the present invention, there is provided a connector for a heat exchanger which includes at least one elongate header of metal, a plurality of refrigerant flow tubes each having one open end exposed to the interior of the header and a plurality of heat radiation fins extending along the tubes. The connector is constructed of metal and brazed to the header to provide a fluid communication between the interior of the header and an external pipe member through an opening formed in a wall of the header. The connector comprises a mating surface which mates the wall of the header; a connecting surface positioned at an opposite side of the mating surface; a pair of side surfaces each being positioned between the mating and connecting surfaces; a through bore which extends between the mating and connecting surfaces; and a groove formed in each of the side surfaces along an axis of the elongate header, the groove being positioned close to the mating surface to leave or define therebetween a thin mounting portion of the connector, the thin mounting portion being so sized as to achieve a desired argon arc spot welding between the connector and the wall of the header.

According to a second aspect of the present invention, there is provided a heat exchanger which comprises at least one elongate header of aluminum alloy; a plurality of refrigerant flow tubes each having one open end exposed to the interior of the header; a plurality of heat radiation fins extending along the tubes; and a connector of aluminum alloy mounted to the header to provide a fluid communication between the interior of the header and an external pipe member through an opening formed in a wall of the header, the connector including a mating surface which is brazed to the wall of the header; a connecting surface positioned at an opposite side of the mating surface; a pair of side surfaces each being positioned between the mating and connecting surfaces; a through bore which extends between the mating and connecting surfaces; and a groove formed in each of the side surfaces along an axis of the elongate header.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
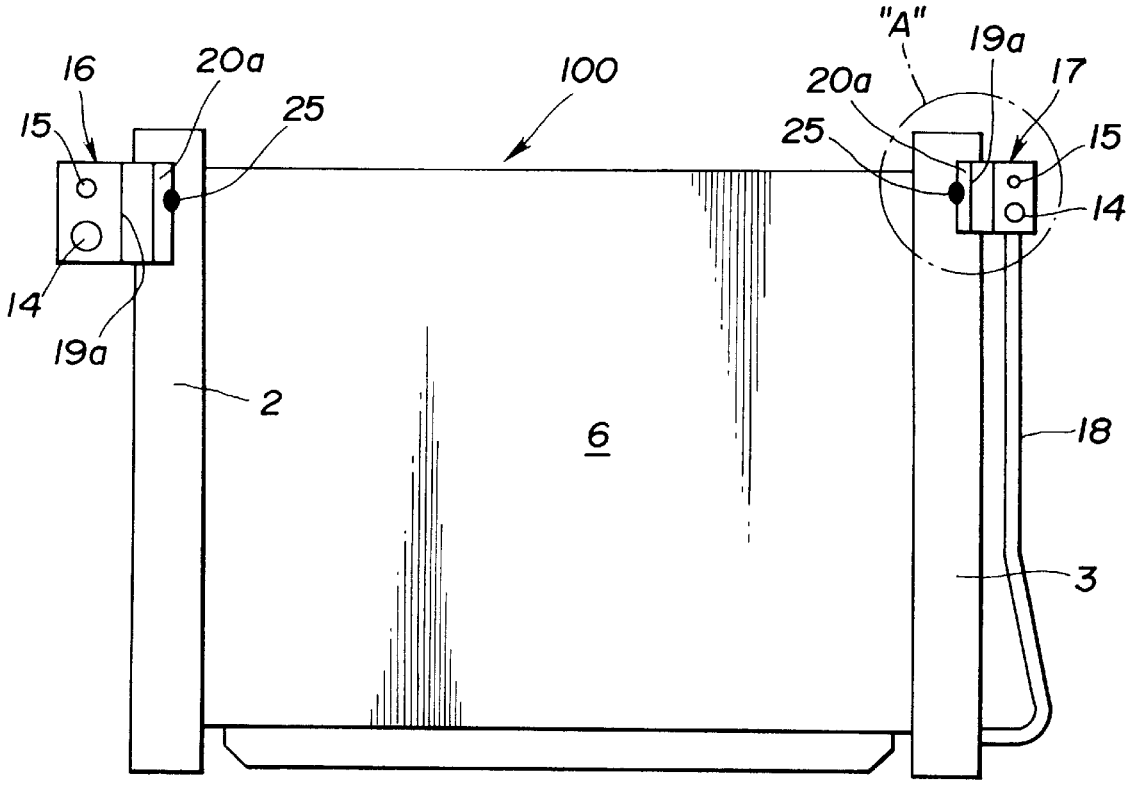
FIG. 1 is a front view of a heat exchanger to which connectors of the present invention are practically mounted.

Referring to FIGS. 1 to 4, particularly FIG. 1, there is shown a heat exchanger 100 to which two connectors 16 and 17 of the present invention are practically mounted.

Figure 5:
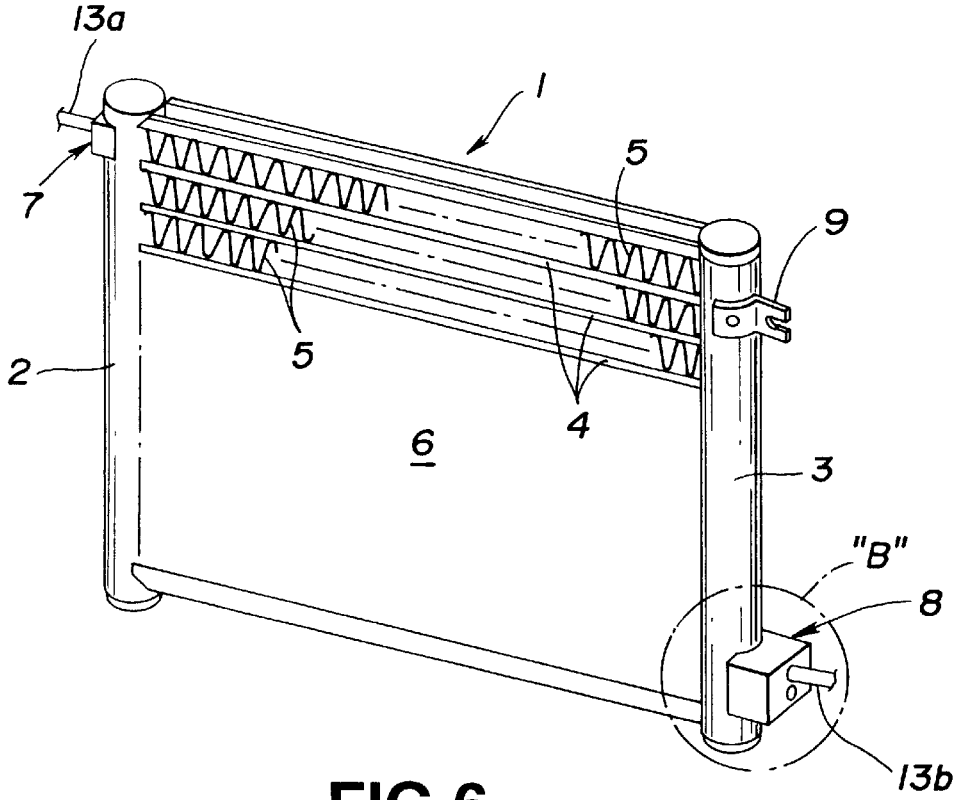
FIG. 5 is a perspective view of a heat exchanger to which conventional connectors are mounted.
Figure 6:
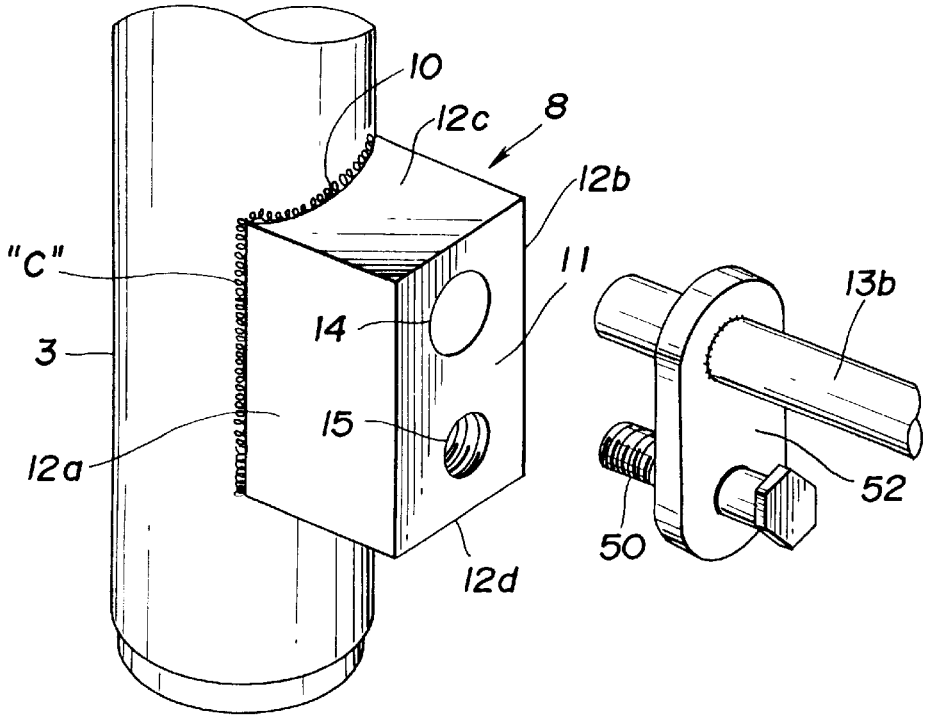
FIG.6 ( PRIOR ART )
FIG. 6 is an enlarged perspective view of a portion indicated by "B" in FIG. 5, showing a conventional outlet connector mounted to an outlet header.

In the following, similar construction and parts to those of the above-mentioned heat exchanger 1 of FIG. 5 are denoted by the same numerals and detailed description of them will be omitted for simplification of the description.

Similar to the heat exchanger 1 of FIG. 5, the heat exchanger 100 comprises inlet and outlet headers 2 and 3 which are laterally spaced. Each header 2 or 3 is constructed of an aluminum alloy or the like. Between the headers 2 and 3, there extend a plurality of rectangular-section refrigerant flow tubes and a plurality of corrugated heat radiation fins which are alternatively arranged to constitute a core portion 6 of the heat exchanger 100. The tubes and fins are each constructed of an aluminum alloy or the like. Each header 2 or 3 is a cylindrical hollow member having upper and lower ends hermetically closed.

Inlet and outlet connectors 16 and 17 are mounted to upper portions of the inlet and outlet headers 2 and 3 respectively. These connectors 16 and 17 are each constructed of an aluminum alloy or the like. Similar to the above-mentioned conventional connectors 7 and 8, the connectors 16 and 17 have each a through bore 14 and a threaded bore 15 for the above-mentioned purposes.

The through bore 14 of the inlet connector 16 is directly exposed to the interior of the inlet header 2 through an opening formed in the cylindrical wall of the inlet header 2, while, the through bore 14 of the outlet connector 16 is connected to the interior of a lower portion of the outlet header 3 through a refrigerant flow tube 18 extending therebetween. It is to be noted that mounting both the inlet and outlet connectors 16 and 17 to the upper portions of the headers 2 and 3 facilitates the manual work with which piping for the air cooling system is carried out in a limited engine room of an associated motor vehicle.

Since the inlet and outlet connectors 16 and 17 are substantially the same in construction except for the above-mentioned through bore 14, the following description will be directed to only the outlet connector 17 for simplification of explanation.

Figure 3:
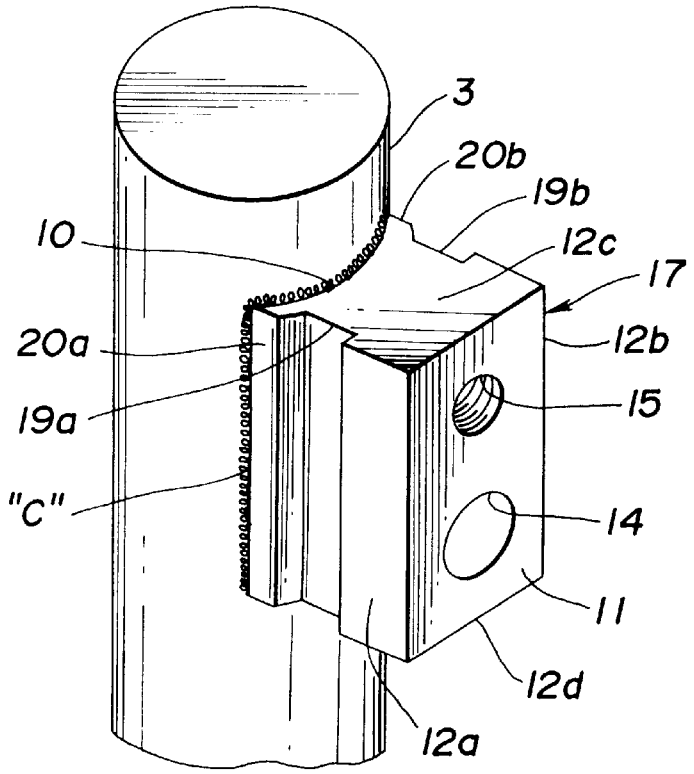
FIG. 3 is a perspective view of a portion indicated by "A" in FIG. 1, showing an outlet connector mounted to an outlet header.

As is seen from FIG. 3, the outlet connector 17 is of a generally rectangular-parallelepiped block including six surfaces, which are a header mating surface 10, a pipe connecting surface 11, a pair of side surfaces 12*a* and 12*b*, an upper surface 12*c* and a lower surface 12*d*. The mating surface 10 is concave to intimately mate with a cylindrical surface of the outlet header 3. The outlet connector 17 is secured to the outlet header 3 through brazing "C" applied entirely to the mating portions of the connector 17 and the header 3. For the brazing "C", the header 3 has a brazing sheet (clad) previously applied thereto. The through bore 14 and the threaded bore 15 are exposed to the connecting surface 11, as shown.

As is seen from FIG. 3, the outlet connector 17 is formed at the side surfaces 12*a* and 12*b* thereof with respective grooves 19*a* and 19*b* which extend along an axis of the outlet header 3. As shown, each groove 19*a* or 19*b* has a rectangular cross section and is positioned close to the mating surface 10 to leave therebetween a thin mounting portion 20*a* or 20*b* of the connector 17. Preferably, the thickness of the thin mounting portion 20*a* or 20*b* is equal to that of the cylindrical wall of the outlet header 3 for the reason which will become apparent hereinafter.

Figure 4:
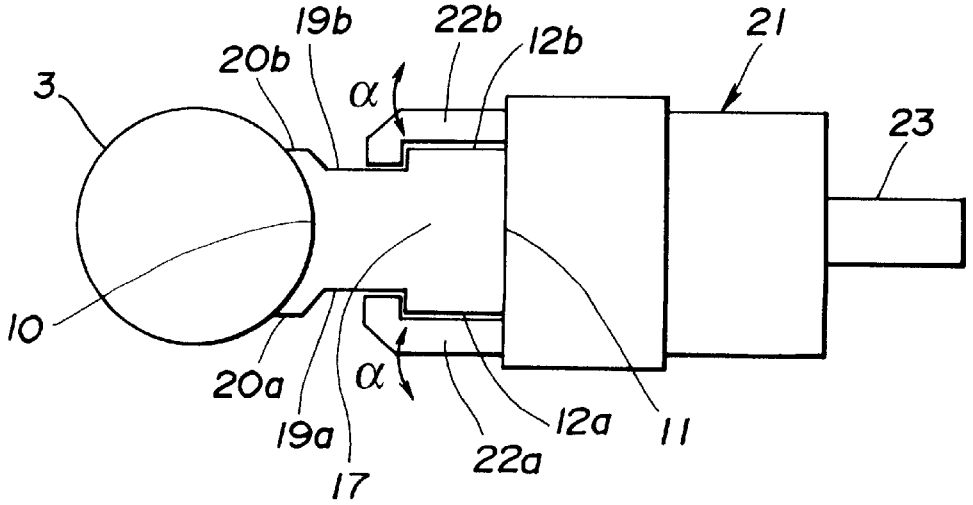
FIG. 4 is plan view of the portion "A" in a condition wherein a tool for leakage test is fitted to the outlet connector.

As is understood from FIG. 4, the grooves 19*a* and 19*b* are shaped and sized to engage with catching pawls 22*a* and 22*b* of a tool 21 for leakage test. Designated by numeral 23 is an air feeding tube which extends to the tool 21 from an air compressor (not shown). Although not shown in the drawing, the tool 21 has a nozzle which is mated and connected with the through bore 14 of the outlet connector 17 when the catching pawls 22*a* and 22*b* of the tool 21 are properly engaged with the grooves 19*a* and 19*b* in the illustrated manner. Each catching pawl 22*a* or 22*b* is pivotal in the direction of "α" to facilitate mounting and demounting of the tool 21 to and from the connector 17.

For producing the connector 17, a metal extruding technique is employed. That is, by using an extruder, an elongate extruded block of aluminum alloy is provided, which has the same cross section as the connector 17 shown in FIG. 3. Then, the elongate extruded block is cut into pieces for respective connectors. Then, each piece is machined to provide the through bore 14 and the threaded bore 15.

Like the case of the heat exchanger 1 of FIG. 5, tight assembling of the heat exchanger 100 is achieved through brazing in a furnace of a certain atmosphere. Before the brazing, the inlet and outlet connectors 16 and 17 are provisionally fixed to the respective headers 2 and 3 through argon arc spot welding.

In the following, advantages of the present invention will be described.

Figure 2:
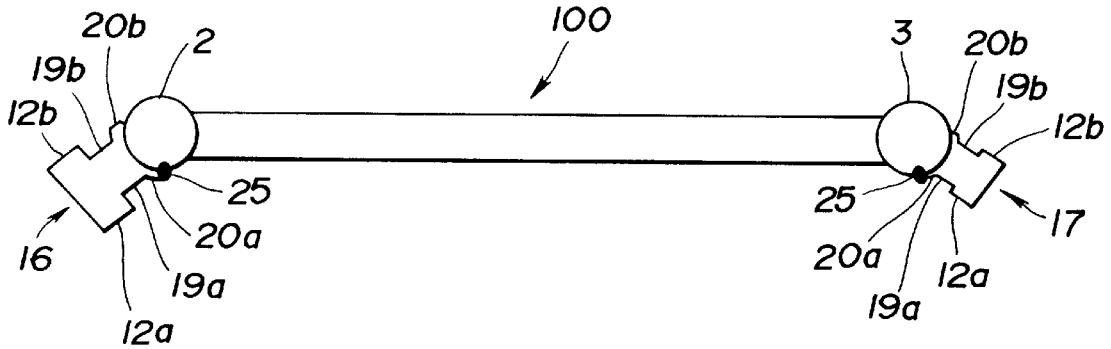
FIG. 2 is a plan view of the heat exchanger of FIG. 1.

First, it is easy to effectively use the argon arc spot welding for provisionally fixing the inlet or outlet connector 16 or 17 to the header 2 or 3. That is, due to the thin mounting portions 20*a* and 20*b* which have a smaller thermal capacity as the portions of the headers 2 and 3 to which the connectors 16 and 17 are mounted, desired argon arc spot welding is achieved at the mating portions therebetween. In FIGS. 1 and 2, the mating portions to which the argon arc spot welding is practically applied are designated by numeral 25.

Second, the leakage test is easily carried out. That is, by fitting respective tools 21 to the inlet and outlet connectors 16 and 17 in the above-mentioned simple manner, the test can be instantly started. For this test, one of the tools 21 may be so constructed as to close the corresponding through bore 14. Upon finishing the leakage test, the tools 21 can be instantly removed from the connectors 16 and 17 by only manipulating the catching pawls 22*a* and 22*b* of the tools 21.

These advantages are not expected in the in the above-mentioned conventional connectors 7 and 8 due to lack of the above-mentioned unique structure possessed by the connectors 16 and 17 of the invention.

Although a specific embodiment of this invention has been shown and described, it will be understood that various modifications may be made without departing from the spirit of this invention. Accordingly, the subject invention is only to the limited by the scope of claims and their equivalents.

What is claimed is:

1. In a heat exchanger including at least one elongate header of metal, a plurality of refrigerant flow tubes each having one open end exposed to an interior of the header and a plurality of heat radiation fins extending along the tubes, a connector of metal brazed to the header to provide a fluid communication between the interior of the header and an external pipe member through an opening formed in a wail of the header, said connector comprising:

a mating surface which mates to the wall of the deader;

a connecting surface positioned at an opposite side of said mating surface;

a pair of side surfaces each being positioned between the mating and connecting surfaces;

a through bore which extends between said mating and connecting surfaces; and a groove formed in each of said side surfaces along an axis of the elongate header, said groove being positioned close to said mating surface to define therebetween a thin mounting portion of said connector, said thin mounting portion being so sized as to achieve a desired argon arc spot welding between said connector and the wall of the header, said thin mounting portion having a thermal capacity generally equal to that of a portion of the header to which said connector is welded.

2. A connector as claimed in claim 1, in which said groove has a rectangular cross section.

3. A connector as claimed in claim 2, further comprising a threaded bore which extends from said connecting surface toward said mating surface.

4. A connector as claimed in claim 1, in which said mating surface is concave in shape.

5. A connector as claimed in claim 1, in which the thickness of said thin mounting portion is substantially the same as that of the wall of the header.

6. A connector as claimed in claim 5, in which the connector is constructed of an aluminum alloy.

7. A heat exchanger comprising:

at least one elongate header of aluminum alloy;

a plurality of refrigerant flow tubes each having one open end exposed to an interior of said header;

a plurality of heat radiation fins extending along said tubes; and a connector of aluminum alloy mounted to said header to provide a fluid communication between the interior of said header and an external pipe member through an opening formed in a wall of said header, said connector including:

a mating surface which is brazed to the wall of said header;

a connecting surface positioned at an opposite side of said mating surface;

a pair of side surfaces each being positioned between said mating and connecting surfaces;

a through bore which extends between said mating and connecting surfaces; and a groove formed in each of said side surfaces along an axis of said header, said groove being positioned close to said mating surface to define therebetween a thin mounting portion of said connector, said thin mounting portion having a thermal capacity generally equal to that of a portion of said header to which said connector is welded.

8. A heat exchanger as claimed in claim 7, in which said thin mounting portion being so sized as to achieve a desired argon arc spot welding between said connector and the wall of said header.

9. A heat exchanger as claimed in claim 8, in which said groove has a rectangular cross section to be easily caught by a catching pawl of a leakage tester.

10. A heat exchanger as claimed in claim 7, in which said header is cylindrical and in which the mating surface of said connector is concave to intimately contact with the cylindrical wall of the header.

11. A heat exchanger as claimed in claim 7, further comprising a tube which extends along said header to provide a fluid communication between the through bore of said connector and the opening formed in the wall of said header.

12. In a heat exchanger including at least one elongate header of metal, a plurality of refrigerant flow tubes each having one open end exposed to an interior of the header and a plurality of heat radiation fins extending along the tubes, A connector mounted to the header to provide fluid communication between the interior of the header and an external pipe member through an opening formed in a wall of the header, said connector comprising:

a mating surface which mates to the wall of the header;

a connecting surface for connecting to the external pipe member;

first and second surfaces positioned between said mating and connecting surfaces; and a through bore which extends between said mating and connecting surfaces;

wherein said first and second surfaces each include a groove formed along an axis of the header, each said groove being positioned close to said mating surface to define therebetween a thin mounting portion of said connector, said thin mounting portion having a thermal capacity generally equal to that of a portion of the header to which said connector is welded.

* * * * *